US006227880B1

(12) United States Patent
Zhu et al.

(10) Patent No.: US 6,227,880 B1
(45) Date of Patent: May 8, 2001

(54) STACKED ELECTRICAL CONNECTOR WITH A SINGLE GROUNDING DEVICE

(75) Inventors: ZiQiang Zhu; Zhonghua Yao, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,869

(22) Filed: Dec. 29, 1999

(30) Foreign Application Priority Data

Dec. 14, 1999 (TW) ..... 088221285

(51) Int. Cl.[7] ..... H01R 4/66
(52) U.S. Cl. ..... 439/92; 439/607; 439/939
(58) Field of Search ..... 439/92, 541.5, 439/607–610, 939, 79

(56) References Cited

U.S. PATENT DOCUMENTS 5,755,595 * 5/1998 Davis et al. ..... 439/607
5,797,770 * 8/1998 Davis et al. ..... 439/607
6,027,375 * 2/2000 Wu ..... 439/607

* cited by examiner

*Primary Examiner*—Gary F. Paumen
(74) *Attorney, Agent, or Firm*—Wei Te Chung

(57) ABSTRACT

A stacked electrical connector for conserving space on a printed circuit board comprises a plurality of shells including an upper shell, a lower shell and a rear shell, an insulative housing, a grounding device and a plurality of contacts. The housing forms a first section, a second section and a protruding section. The protruding section has top and bottom surfaces defining recesses in central portions thereof. The grounding device has a fixing section abutting against a front face of the protruding section, a middle section and a front engaging section exposed to a mating face of the connector for engaging with a panel of a computer. The fixing section forms upper and lower retainers respectively engaging with the upper and lower shells.

1 Claim, 5 Drawing Sheets

STACKED ELECTRICAL CONNECTOR WITH A SINGLE GROUNDING DEVICE

BACKGROUND OF THE INVENTION

Field of the Invention

The present invention relates to a stacked electrical connector with a single grounding device.

As more functions are added to computers, the available space on printed circuit boards becomes more limited. It is desirable to minimize the amount of space required on a printed circuit board for connectors. Connectors can be stacked closely together on a circuit board to conserve space and thus stacked connectors were invented. However, stacked connectors generate an undesirable amount of electrical noise. Hence, stacked connectors with a single grounding device are required to prevent generation of EMI.

SUMMARY OF THE INVENTION

An object of the present invention is to provide a stacked electrical connector with a single grounding device that has sufficient resiliency, and can be easily manufactured.

A stacked electrical connector in accordance with the present invention comprises a plurality of shells, an insulative housing, a grounding device and a plurality of contacts. The plurality of shells include an upper shell, a lower shell and a rear shell, which are identical to those of a conventional connector thus decreasing the manufacturing cost. The irregular housing forms a first section, a second section and a protruding section. The first and second sections respectively extend into the upper and lower shells, each section having a plate shape and defining a plurality of contact receiving slots in upper and lower surfaces thereof for receiving horizontal sections of the contacts. The contacts also have vertical sections, which extend vertically through the housing to mate with a printed circuit board. The protruding section has top and bottom surfaces defining recesses in central portions thereof. The grounding device is produced using a stamping process and is bent to form three sections which are a rear fixing section, a middle section and a front engaging section, the engaging section being exposed at a mating face of the connector. The fixing section abuts against a front face of the protruding section and forms upper and lower retainers respectively received in the recesses of the protruding section. Each retainer forms a spring tab for engaging with corresponding upper and lower shells.

Other objects, advantages and novel features of the invention will become more apparent from the following detailed description of the present embodiment when taken in conjunction with the accompanying drawings.

DETAILED DESCRIPTION OF THE INVENTION

Figure 1:
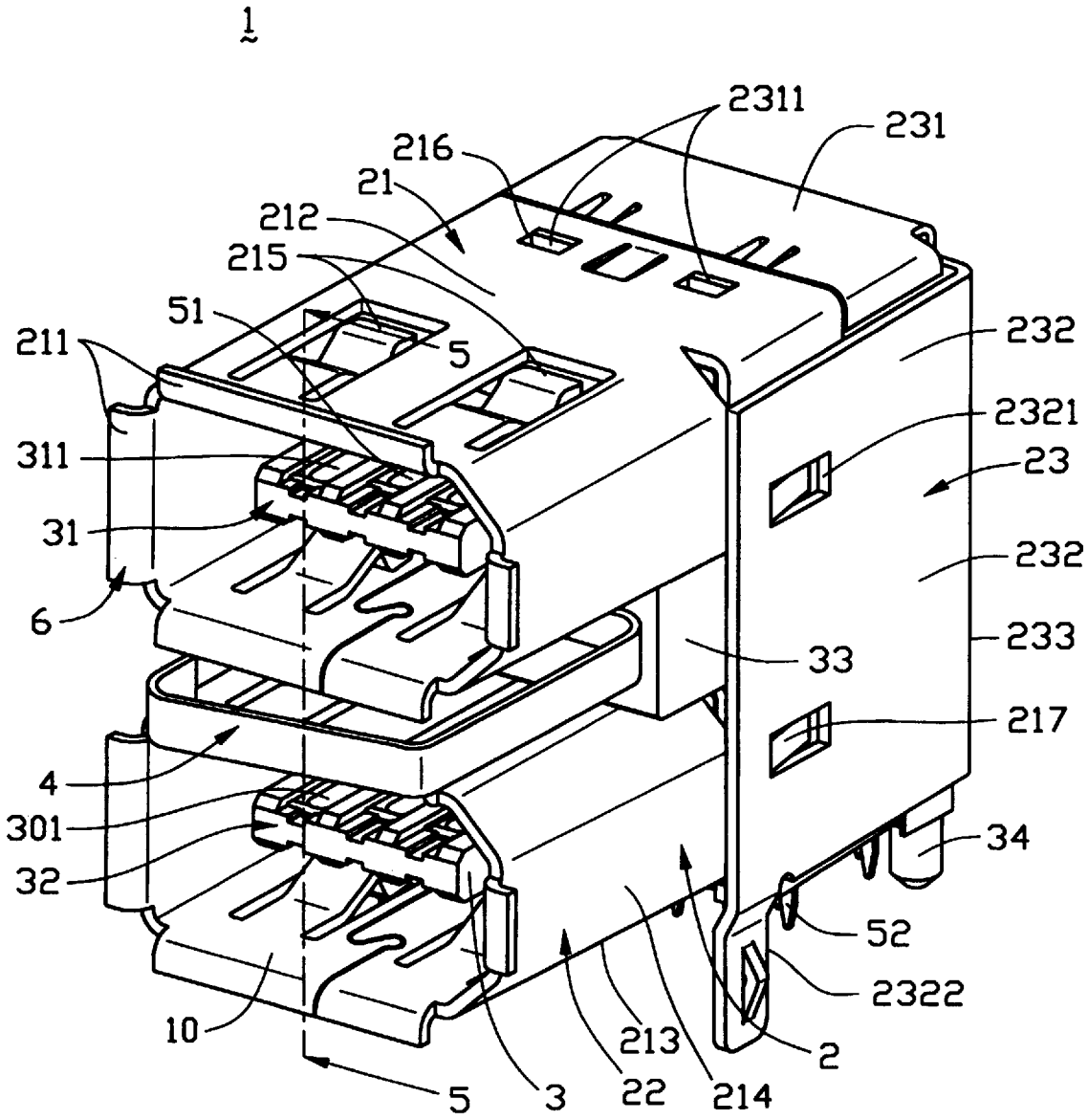
FIG. 1 is an assembled view of an electrical connector in accordance with the present invention.
Figure 2:
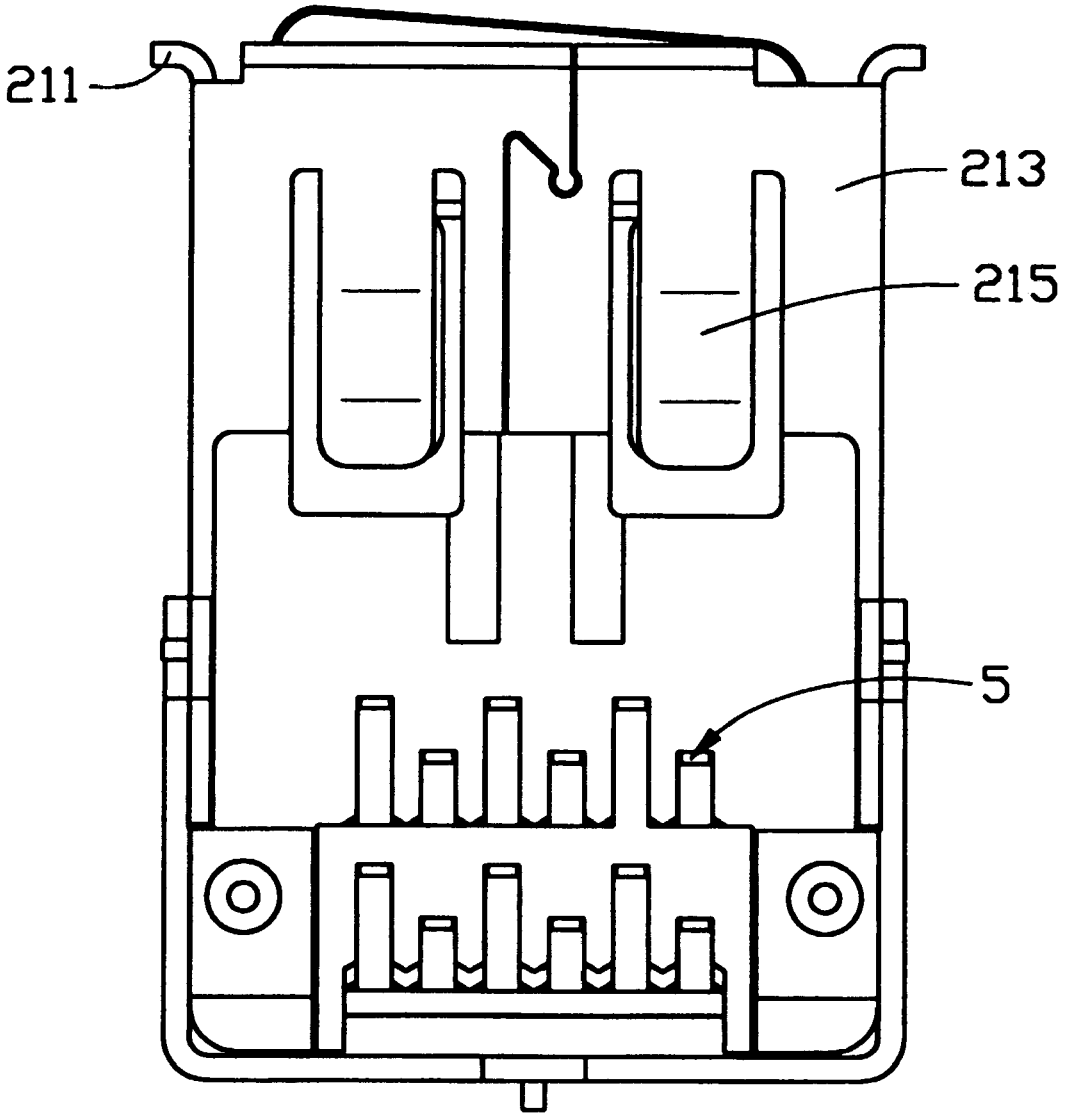
FIG. 2 is a bottom view of the connector of FIG. 1.
Figure 3:
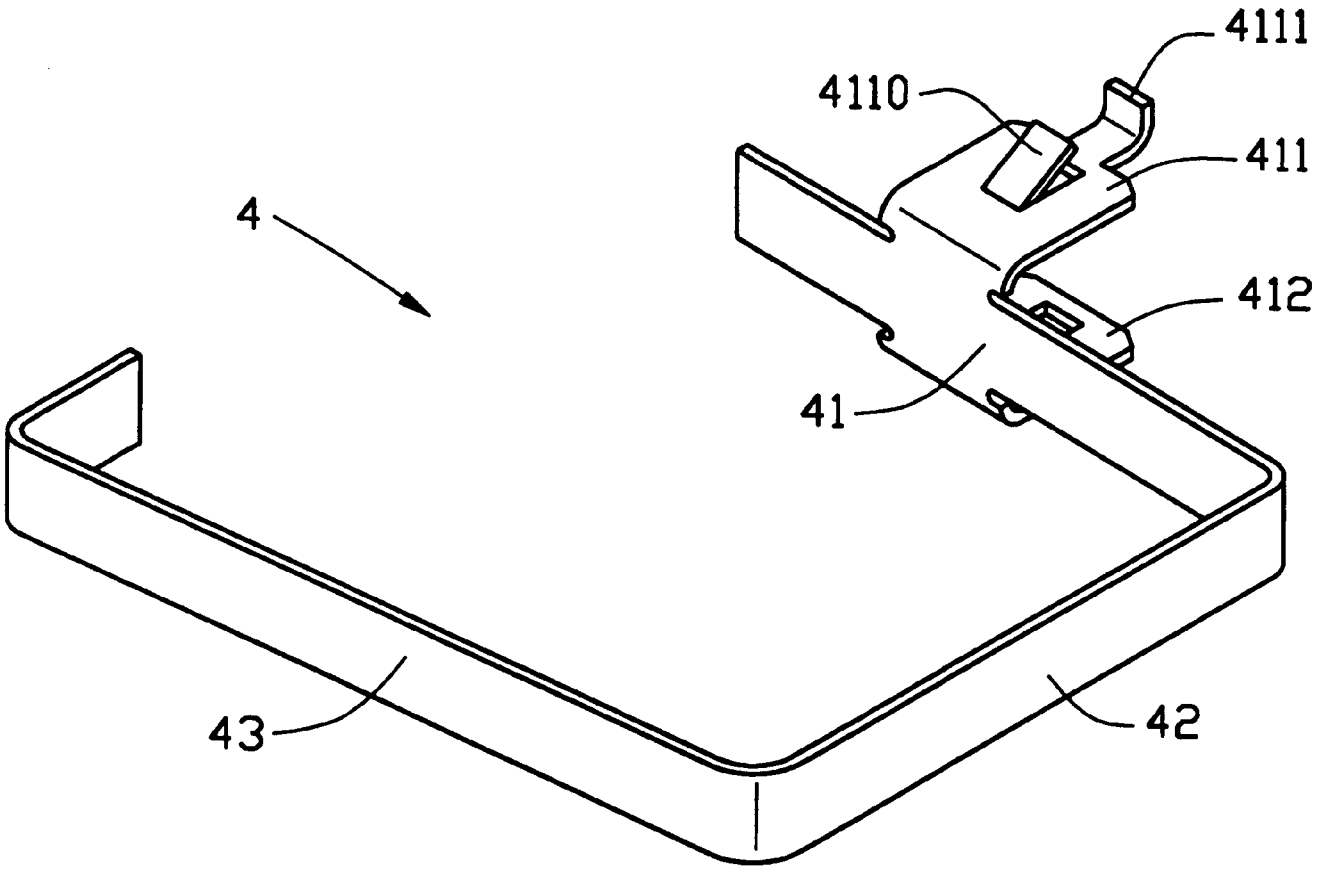
FIG. 3 is a perspective view of a grounding device in accordance with the present invention.

Referring to FIGS. 1–3, a stacked electrical connector 1 with a mating face 6 in accordance with the present invention comprises a plurality of shells 2, an insulative housing 3, a grounding device 4 and a plurality of contacts 5.

The shells 2 comprise an upper shell 21, a lower shell 22 and a rear shell 23, which are identical to those of a conventional connector thus decreasing the design time and manufacturing cost. The upper shell 21 is identical to the lower shell 22, each having a top plate 212, a bottom plate 213 and two opposite side plates 214. Each shell 21, 22 forms an array of short arcuate flanges 211 aligning with the mating face 6 for engaging with a panel of a computer (not shown). A pair of spring tabs 215 is respectively provided on the top plate 212 and the bottom plate 213 of each shell 21, 22 for engaging with a shield of a mating plug connector (not shown) to maintain a mated condition and to ground the shield of the mating plug connector. A pair of holes 216 is defined in a rear side of the top plate 212 of each shell 21, 22 and an embossment 217 is formed on each side plate 214 laterally protruding therefrom. The rear shell 23 has a top plate 231, two opposite side plates 232 and a rear plate 233. The top plate 231 forms a pair of retaining tabs 2311 at a distal end thereof which are upwardly crimped and extend into the holes 216 in the top plate 212 of the upper shell 21 for fixing during assembly. A pair of holes 2321 is defined in each side plate 232 of the rear shell 23 for receiving the embossments 217 on side plate 214 of each shell 21, 22. A positioning leg 2322 is formed at a front lower edge of each side plate 232 extending downwardly for engaging with a hole in a printed circuit board (not shown) for positioning purposes. During assembly, the rear shell 23 encloses a rear portion of the stacked connector for protecting against transmission from and reception of electromagnetic interference by the enclosed stacked connectors.

Figure 4:
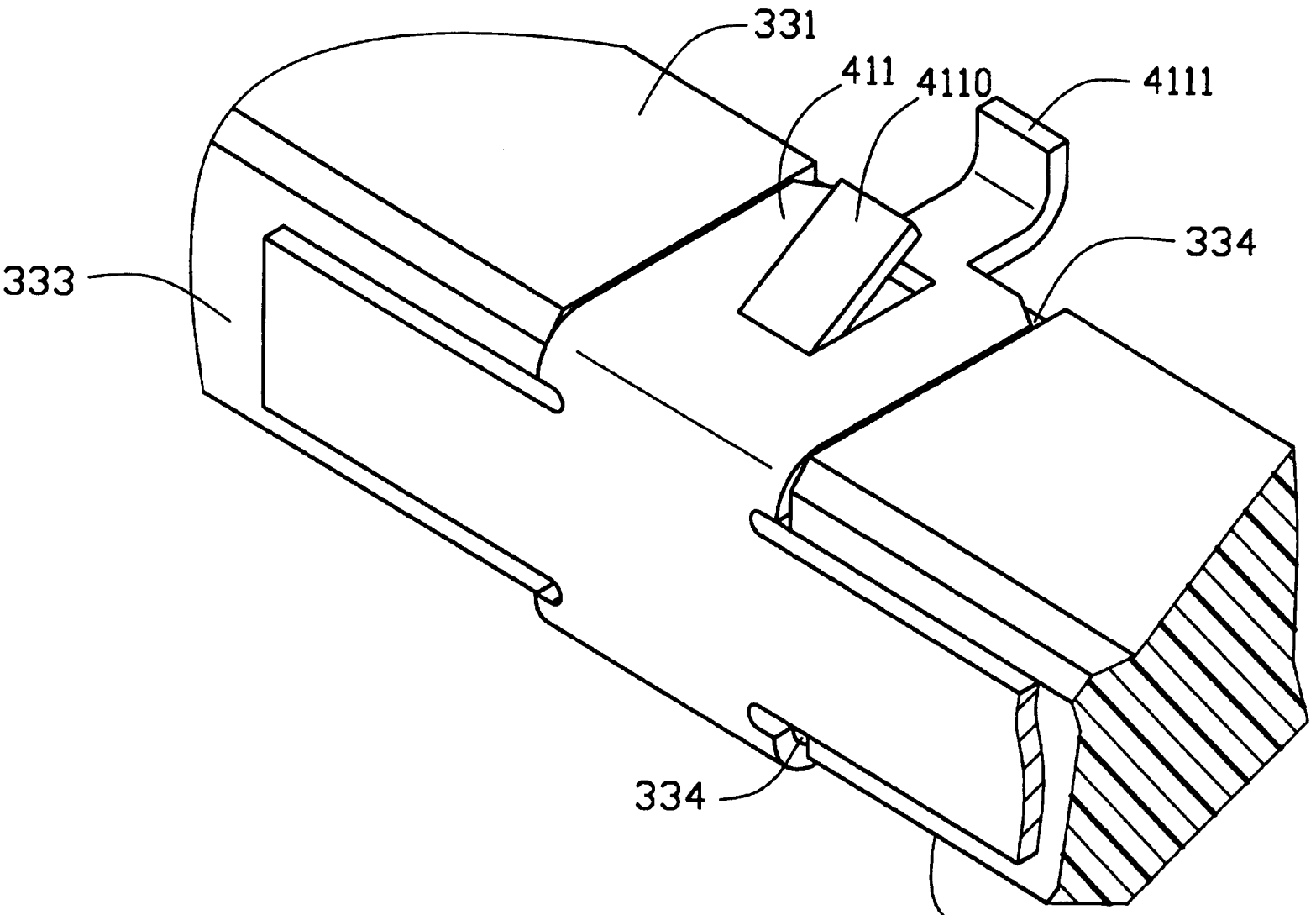
FIG. 4 is an assembled view of the grounding device and the protruding section of the housing of the electrical connector of the present invention.
Figure 5:
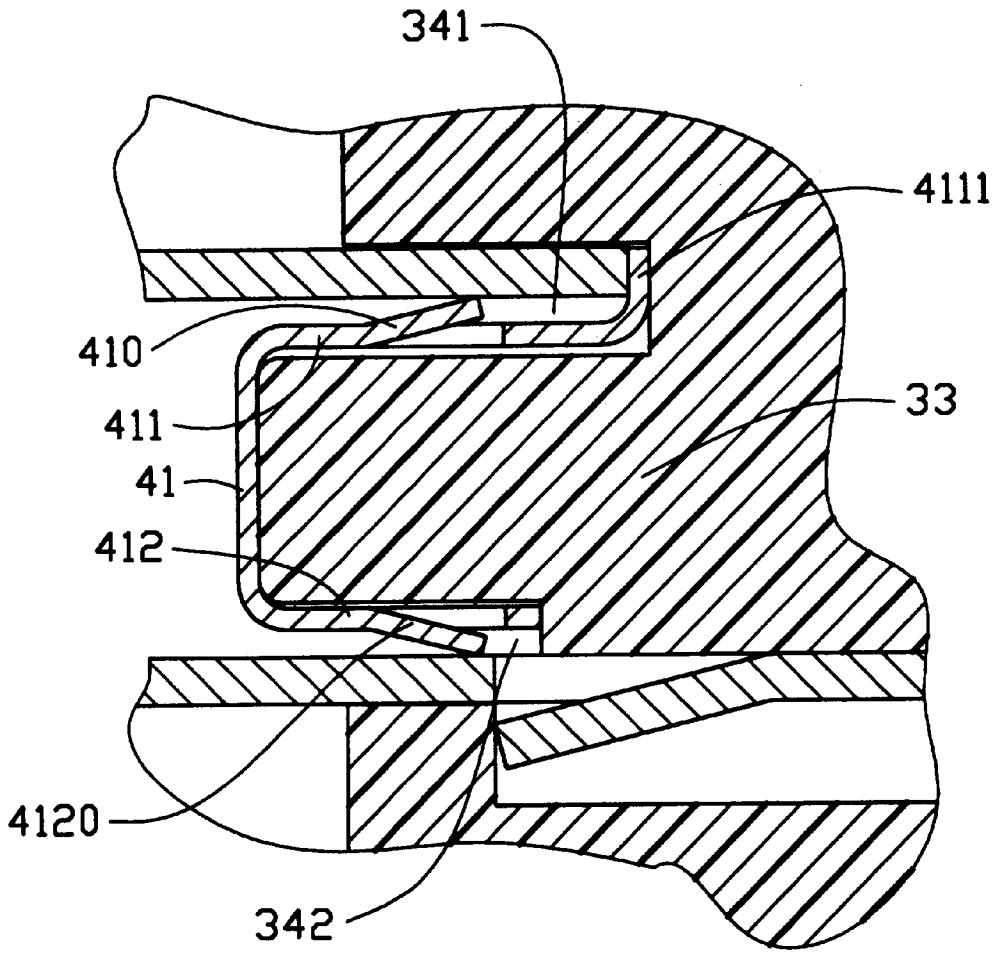
FIG. 5 is a sectional view taken along line 5—5 in FIG. 1.

Now referring to FIGS. 1, 4 and 5, the irregular-shaped housing 3 has a first section 31 extending into the upper shell 21 and a second section 32 extending into the lower shell 22. The first section 31 and the second section 32 are both plate-shaped and define a plurality of contact receiving slots 301 on upper and lower surfaces thereof for receiving horizontal sections 51 of contacts 5 which further include vertical sections 52 extending into the holes of the printed circuit board (not shown). The housing 3 forms a protruding section 33 forwardly extending out of the rear shell 23 and between the upper shell 21 and lower shell 22. The protruding section 33 has a top surface 331 and a bottom surface 332, each defining a recess 334 on a central position thereof, and a front face 333. A first slot 341 is defined between the bottom plate 213 of the upper shell 21 and the protruding section 33 and a second slot 342 is defined between the protruding section 33 and the top plate 212 of the lower shell 22. A pair of positioning posts 34 is formed on opposite lower sides of the housing 3 extending downward for positioning into holes in a printed circuit board (not shown).

The elongate grounding device 4 is manufactured using a stamping process and is bent to form three sections which are a rear fixing section 41, a middle section 42 and a front engaging section 43. The rear fixing section 41 is vertical to the middle section 42 and the front engaging 41 section extends from the middle section 42 in an obtuse angle. The fixing section 41 abuts against a front surface 333 of the protruding section 33 and forms an upper retainer 411 and a lower retainer 412 respectively received in the recesses 334 of the protruding section 33. The upper retainer 411 has a spring tab 4110 extending upwardly and rearwardly into the slot 341 for engaging with the bottom plate 213 of the upper shell 21. The lower retainer 412 has a spring tab 4120 extending downwardly and rearwardly into the second slot 342 for engaging with the top plate 212 of the lower shell 22.

The upper retainer 411 forms a barb 4111 for clipping between a rear end of the bottom plate 213 of the upper shell 21 and the housing 3 for fixing. The engaging section 43 is exposed to the mating face 6 of the electrical connector 1 for resilient engagement with the panel of the computer (not shown) to establish ground connection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector comprising:

an insulative housing having a first section, a second section and a protruding section intermediate of the first section and the second section, the protruding section having a top surface, a bottom surface and a front face, the top and bottom surfaces respectively defining a recess;

a plurality of contacts received in the first section and the second section of the insulative housing;

a grounding device being fixed on the protruding section of the housing, the grounding device including a rear fixing section for abutting against the front face of the protruding section of the housing, a middle section and a front engaging section, the fixing section forming upper and lower retainers each received in a corresponding recess of protruding section; and an upper shell secured to the first section of the insulative housing, a lower shell secured to the second section of the insulative housing, and a rear shell covering a rear of the insulative housing and secured to the upper and the lower shells, the upper and lower shells respectively contacting the upper and lower retainers;

wherein the fixing section is vertical to the middle section and the front engaging section extends from the middle section in an obtuse angle;

wherein the upper retainer has a spring tab extending upwardly and rearwardly for engaging with a bottom plate of the upper shell;

wherein the lower retainer has a spring tab extending downwardly and rearwardly for engaging with a top plate of the lower shell;

wherein the upper retainer of the grounding device comprises an upwardly extending barb retained behind a bottom plate of the upper shell;

wherein a pair of holes is defined o a top plate of the upper shell, and wherein a pair of retaining tabs is formed on a top plate of the rear shell for engaging with the holes;

wherein an embossment is formed on one of two side plates of each of the upper and the lower shells, and wherein a pair of holes is defined on each side plate of the rear shell for receiving the embossment.

* * * * *